US011414889B2

(12) United States Patent
Shaw et al.

(10) Patent No.: US 11,414,889 B2
(45) Date of Patent: Aug. 16, 2022

(54) ELECTRONIC LOCK APPARATUS

(71) Applicant: Taiwan Colour & Imaging Technology Corporation, Taipei (TW)

(72) Inventors: Chih-An Shaw, Taipei (TW); Yih-Jong Wan, Taipei (TW)

(73) Assignee: TAIWAN COLOUR & IMAGING TECHNOLOGY CORPORATION, Taipei (TW)

( * ) Notice: Subject to any disclaimer, the term of this patent is extended or adjusted under 35 U.S.C. 154(b) by 322 days.

(21) Appl. No.: 16/652,622

(22) PCT Filed: Nov. 21, 2017

(86) PCT No.: PCT/CN2017/112155
§ 371 (c)(1),
(2) Date: Mar. 31, 2020

(87) PCT Pub. No.: WO2019/100208
PCT Pub. Date: May 31, 2019

(65) Prior Publication Data

US 2020/0224457 A1 Jul. 16, 2020

(51) Int. Cl.
*E05B 47/00* (2006.01)
*G07C 9/00* (2020.01)

(52) U.S. Cl.
CPC .. *E05B 47/0012* (2013.01); *E05B 2047/0048* (2013.01)

(58) Field of Classification Search
CPC ..... E05B 47/0012; E05B 2047/0048; G07C 9/00174; Y10T 70/7062; Y10T 70/7068;
(Continued)

(56) References Cited

U.S. PATENT DOCUMENTS 5,083,122 A * 1/1992 Clark ..... G07C 9/0069 70/279.1
6,145,353 A * 11/2000 Doucet ..... E05B 47/0692 70/277
(Continued)

FOREIGN PATENT DOCUMENTS

CN 2732925 Y 10/2005
CN 201416300 Y 3/2010
(Continued)

*Primary Examiner* — Lloyd A Gall

(74) *Attorney, Agent, or Firm* — Muncy, Geissler, Olds & Lowe, P.C.

(57) ABSTRACT

An electronic lock apparatus includes an input panel and a control box. The control box includes a box body, a circuit board, a connection cable, a back plate, and a sensing assembly. The circuit board is disposed in the box body, and includes an electronic lock switch control module. The connection cable is disposed on the circuit board, electrically connected to the electronic lock switch control module. The sensing assembly is disposed on the circuit board, faces a back opening of the box body, and is configured to sense whether the back plate covers the back opening. The electronic lock apparatus can provide an unlocking manner of wireless, a biological feature, password entry or a combination thereof as a basis of controlling an electronic lock, and include a safety protection design, to improve safety of near-end and/or remote access control management.

19 Claims, 10 Drawing Sheets

(58) Field of Classification Search
CPC ..... Y10T 70/7102; Y10T 70/7107; Y10T 70/7113; Y10T 70/7119; Y10T 70/7124; Y10T 70/713; Y10T 292/1021
USPC ..... 340/539.31, 426.28
See application file for complete search history.

(56) References Cited

U.S. PATENT DOCUMENTS

| | | | | |
|---|---|---|---|---|
| 2010/0257906 | A1* | 10/2010 | Sorensen | E05B 47/068 70/91 |
| 2012/0006082 | A1* | 1/2012 | Peng | E05B 47/068 70/277 |
| 2021/0062543 | A1* | 3/2021 | Peng | E05B 47/0012 |
| 2021/0164264 | A1* | 6/2021 | McKibben | E05B 49/00 |
| 2021/0285257 | A1* | 9/2021 | Ohl | E05B 55/005 |

FOREIGN PATENT DOCUMENTS

| | | | |
|---|---|---|---|
| CN | 205078020 | U | 3/2016 |
| CN | 205604875 | U | 9/2016 |
| CN | 205713527 | U | 11/2016 |
| CN | 106846592 | A | 6/2017 |
| CN | 206256834 | U | 6/2017 |
| CN | 206290105 | U | 6/2017 |
| EP | 1 213417 | A2 | 6/2002 |
| TW | M399174 | U | 3/2011 |
| WO | WO 2012/119184 | A1 | 9/2012 |

* cited by examiner

ELECTRONIC LOCK APPARATUS

BACKGROUND

Technical Field

The present invention relates to an electronic lock apparatus, and in particular, to an electronic lock control host with a safety protection design such as anti-theft, network intrusion prevention, and internal theft prevention.

Related Art

With the improvement of anti-theft awareness, door locks are gradually upgraded from common cylinder locks to current complex door lock structures most of which are still mainly physical structures, to improve complexity of internal structures of the door locks, and reduce a risk that the locks are cracked. To enhance a function of anti-theft and monitoring, and with the progress of sciences and technologies and the popularization and application of wireless communications devices, currently, a manner of biometric recognition and/or wireless induction is used in common door locks, door locks of safe boxes, or the like to switch or manage the door locks.

However, a control host of this type of door lock is in one-piece design. After mounting, the control host needs to be disposed outside a door. As a result, the control host is easily damaged, and internal control circuits and wires can be seen. Further, the control host is stolen, or the lock is cracked.

SUMMARY

In view of this, the present invention provides an electronic lock apparatus. In some embodiments, the electronic lock apparatus according to the present invention can provide an unlocking manner of wireless, a biological feature, password entry or a combination thereof as a basis of controlling an electronic lock body, and may include a safety protection design such as anti-theft, internal theft prevention and network intrusion prevention, to improve safety of near-end and/or remote access control management.

In an embodiment, an electronic lock apparatus includes an input panel and a control box. The input panel includes an input module and a connection cable, where the connection cable is electrically connected to the input module. The control box includes a box body, a circuit board, a connection hole, a first port, a cover body, a back plate, and a sensing assembly. The box body includes a front plate, a side plate and a back opening. The circuit board is disposed in the box body, and includes an electronic lock switch control module. The connection hole is disposed on the circuit board, electrically connected to the electronic lock switch control module, and embedded on the front plate, where the connection cable is correspondingly connected to the connection hole. The first port is disposed on the circuit board and embedded on the side plate. The cover body is disposed on the box body and covers the side plate on which the first port is disposed. The back plate is locked to the cover body and the box body, and covers the back opening. The sensing assembly is disposed on the circuit board, faces the back opening, and is configured to sense whether the back plate moves.

In an embodiment, an electronic lock apparatus is mounted on a door plate, where the door plate includes an outer surface and an inner surface, and a side wall with an opening is disposed on the inner surface. The electronic lock apparatus includes an input panel, a control box, and a plurality of locking assemblies. The input panel is disposed on the outer surface of the door plate, and includes an input module and a connection cable, where the connection cable is electrically connected to the input module. The control box is disposed on the inner surface of the door plate and closely adjacent to the side wall, and is located at the opening corresponding to the side wall. The control box includes a box body, a circuit board, a connection hole, a first port, a back plate, and a sensing assembly. The box body includes a front plate, a side plate and a back opening, where the side plate is located on one side, facing the side wall, of the box body. The circuit board is disposed in the box body, and includes an electronic lock switch control module. The connection hole is disposed on the circuit board, electrically connected to the electronic lock switch control module, and embedded on the front plate, where the connection cable is connected to the connection hole. The first port is disposed on the circuit board and embedded on the side plate, and corresponds to the opening. The back plate is locked to the box body, and covers the back opening. The sensing assembly is disposed on the circuit board, faces the back opening, and is configured to sense whether the back plate moves, to prevent an internal thief from stealing a device or performing network intrusion after the back plate is opened. The plurality of locking assemblies penetrate through the box body and the door plate through the back opening of the box body, and are locked to the input panel, to fix the input panel and the box body on the door plate.

Based on the foregoing, the electronic lock apparatus according to the present invention may connect an input panel and a control box by disposing a main control circuit in a box body of the control box and by using a connection cable being a single-core cable. In this way, even though the input panel is opened from outside, a door lock switch cannot be controlled by simply damaging the circuit. In addition, all ports are covered, so that when a back plate is not opened, a cover body cannot be removed to unplug cables connected to the ports, or connect to the ports through another control cable or network cable. In this way, an electronic lock switch is prevented from being controlled through a port, and from being intruded or tampered with by connecting to a cloud server through a port network. In addition, through a manner of detecting, by using a sensing assembly, whether the back plate is removed, a warning signal is transmitted when the back plate is opened, damaged or moved. In this way, through a plurality of anti-theft mechanisms, a function of anti-theft, network intrusion prevention, and/or internal theft prevention of the electronic lock apparatus is enhanced.

DETAILED DESCRIPTION

Figure 1:
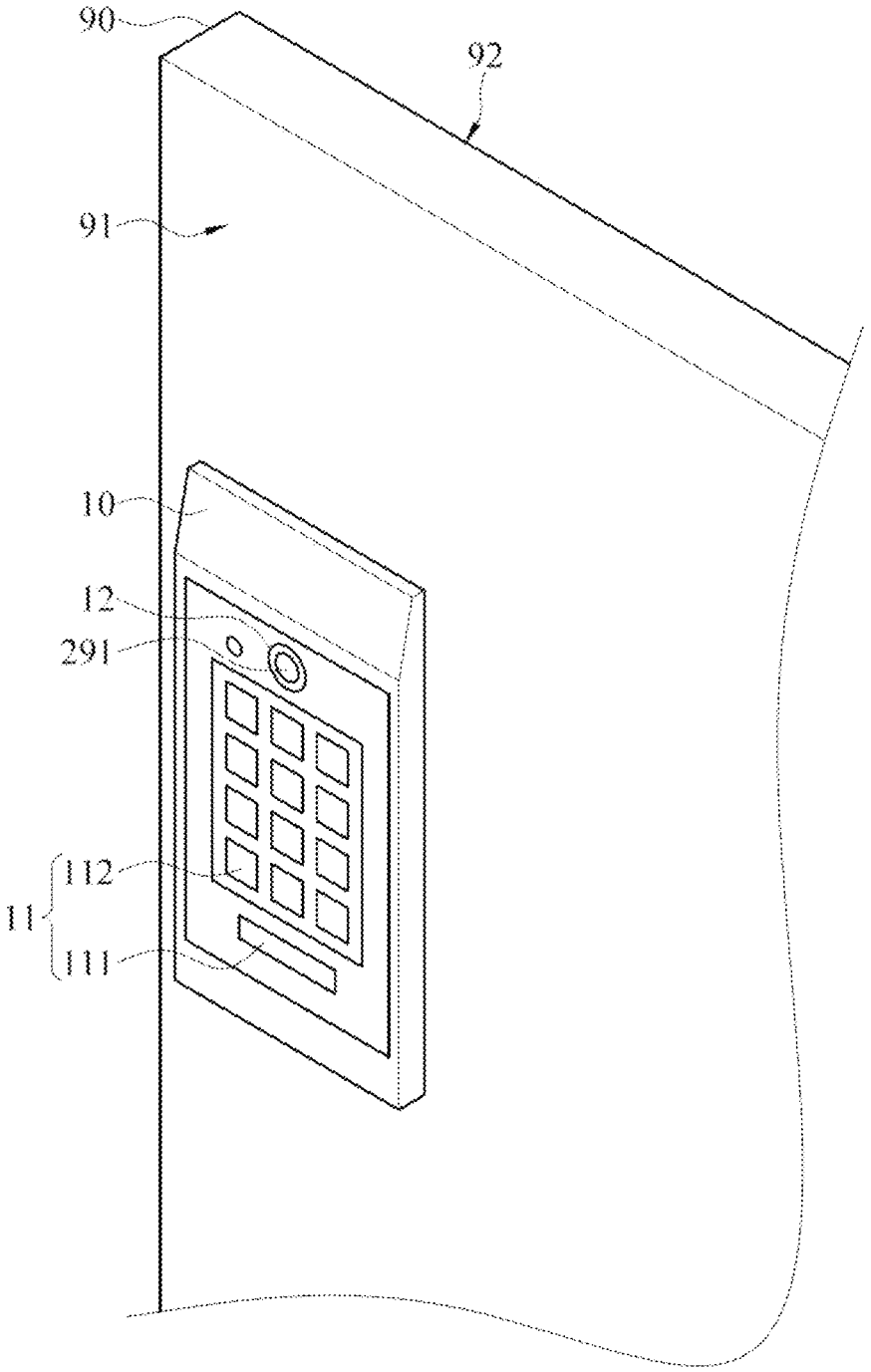
FIG. 1 is a front view of an electronic lock apparatus according to a first embodiment of the present invention.
Figure 2:
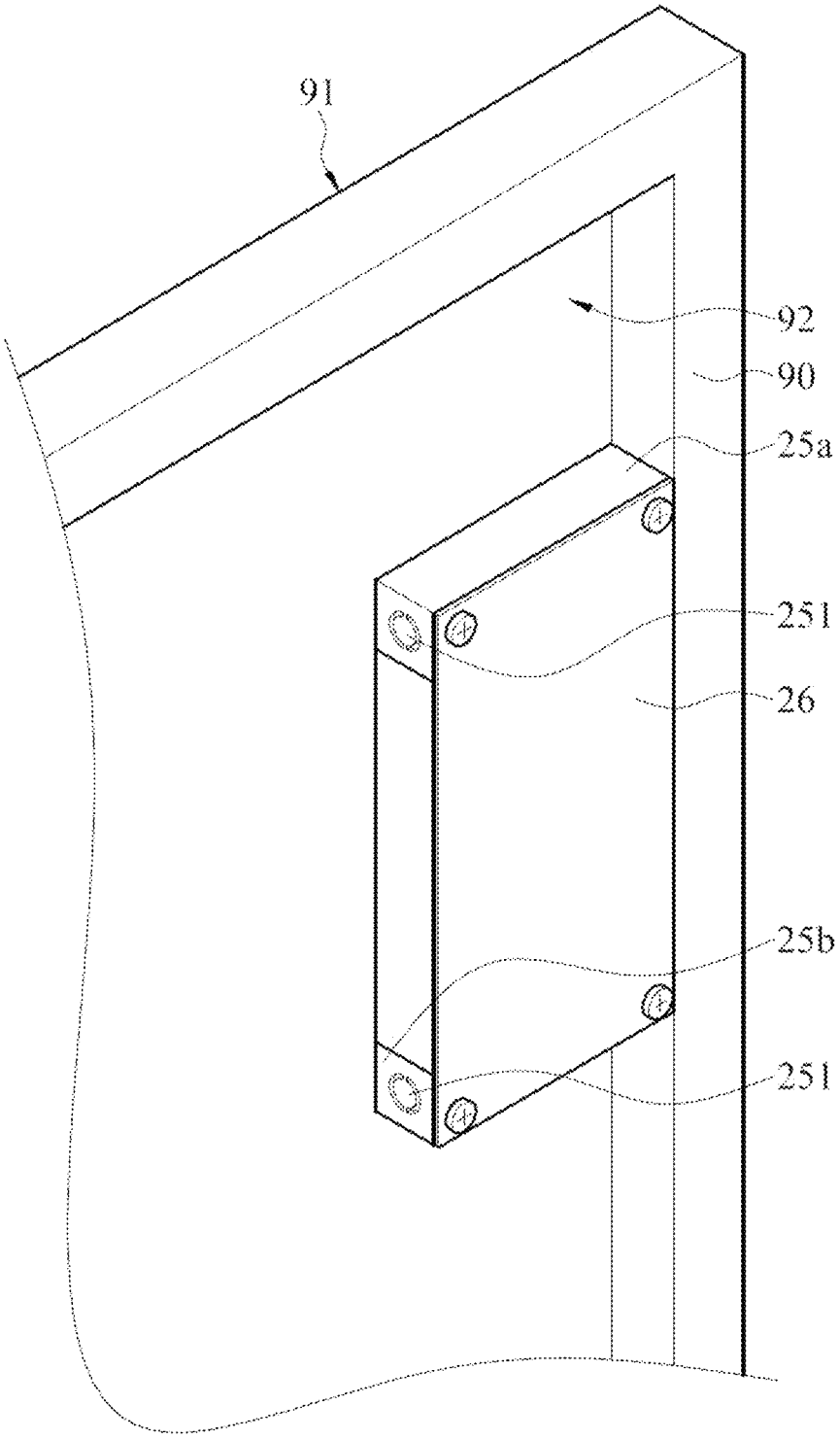
FIG. 2 is a rear view of the electronic lock apparatus according to the first embodiment of the present invention.
Figure 3:
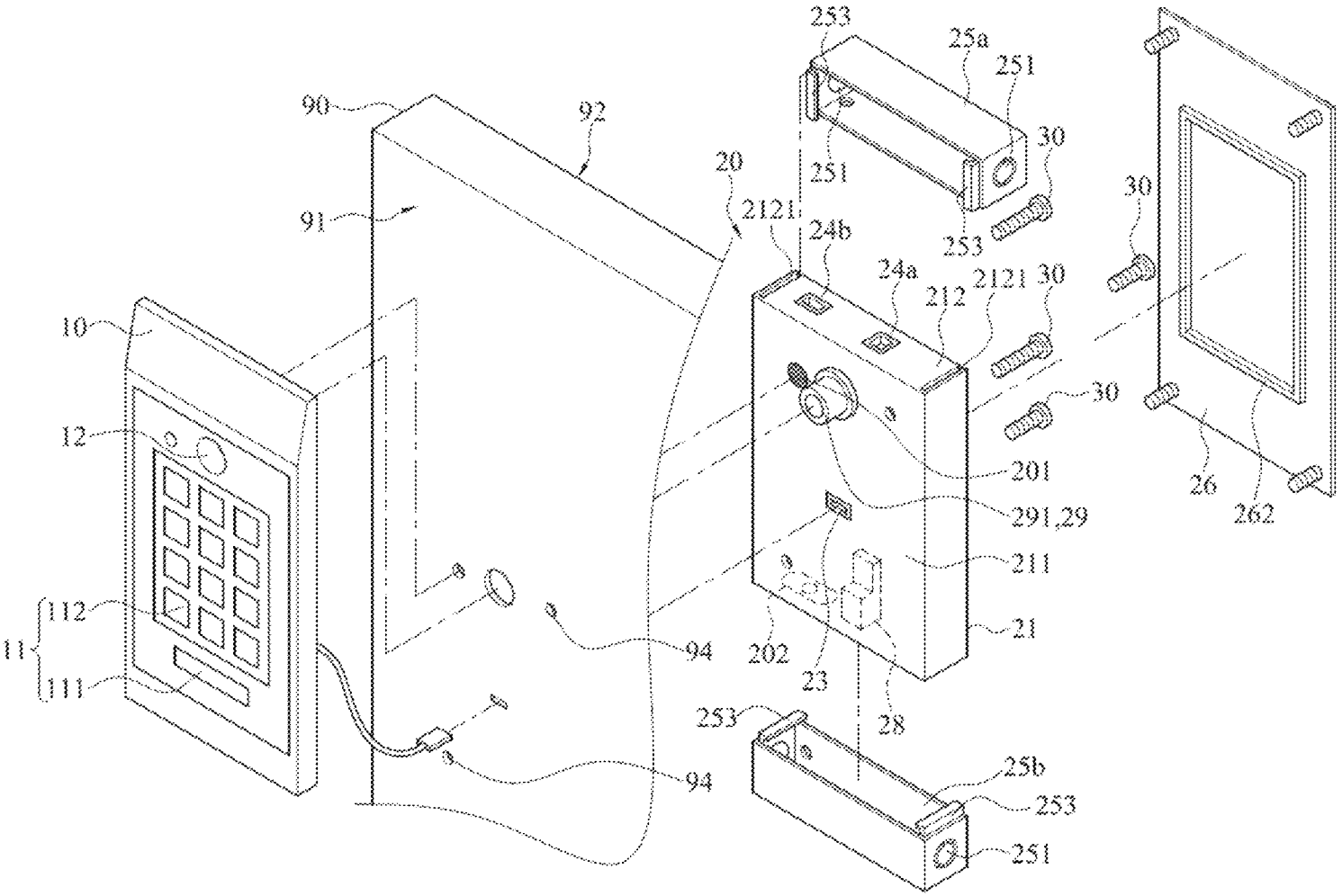
FIG. 3 is an exploded view from a right front view of the electronic lock apparatus according to the first embodiment of the present invention.
Figure 4:
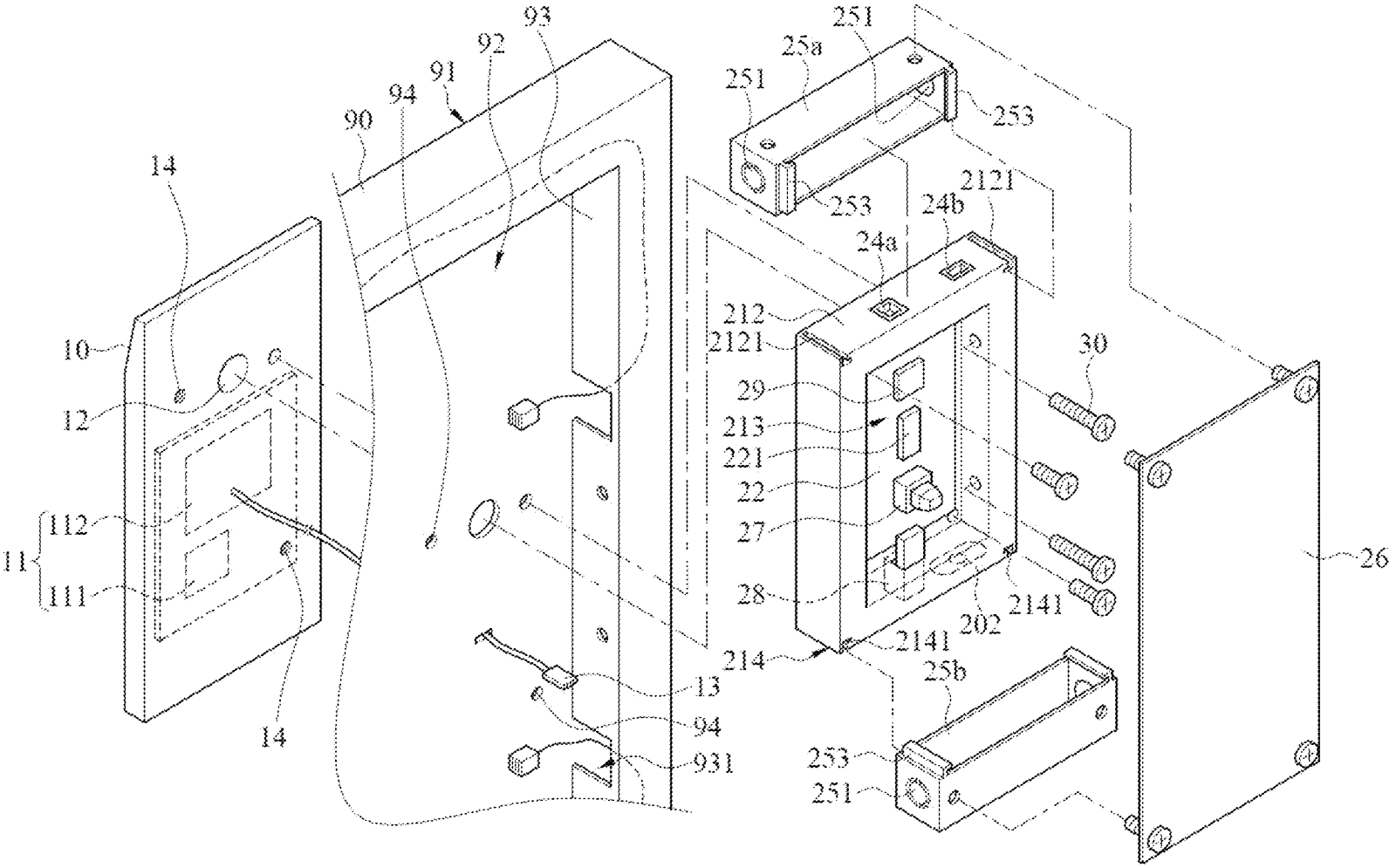
FIG. 4 is an exploded view from a left rear view of the electronic lock apparatus according to the first embodiment of the present invention.
Figure 5:
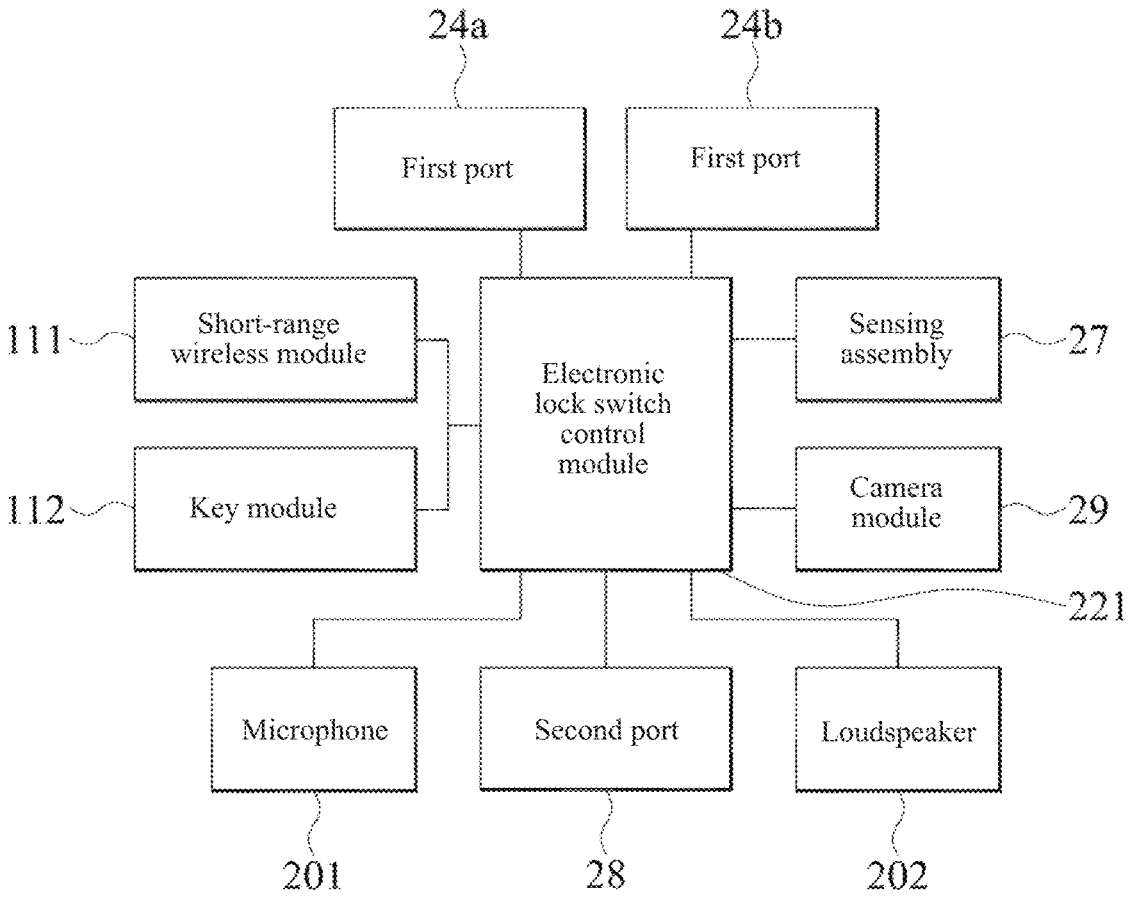
FIG. 5 is a schematic block diagram of electrical connection between electronic assemblies of the electronic lock apparatus according to the first embodiment of the present invention.

Referring to FIG. 1 to FIG. 5, FIG. 1 is a front view of an electronic lock apparatus according to a first embodiment of the present invention; FIG. 2 is a rear view of the electronic lock apparatus according to the first embodiment of the present invention; FIG. 3 is an exploded view from a right front view of the electronic lock apparatus according to the first embodiment of the present invention; FIG. 4 is an exploded view from a left rear view of the electronic lock apparatus according to the first embodiment of the present invention; FIG. 5 is a schematic block diagram of electrical connection between electronic assemblies of the electronic lock apparatus according to the first embodiment of the present invention. In some embodiments, the electronic lock apparatus may be disposed for switch control of a common household door or a door of a place that needs control, or switch control of a computer cabinet, a file cabinet, a safe box, or the like that needs a high-level anti-theft alert function.

The electronic lock apparatus may include an input panel 10 and a control box 20. In this embodiment, the input panel 10 and the control box 20 are respectively disposed on two opposite surfaces of a door plate 90. For ease of description herein, a side, on which the input panel 10 is disposed, of the door plate 90 is defined as an outer surface 91, and a side, on which the control box 20 is disposed, of the door plate 90 is defined as an inner surface 92.

The input panel 10 includes an input module 11 and a connection cable 13. The input module 11 is electrically connected to the connection cable 13, and is electrically connected to an electronic lock switch control module (details are described below) in the control box 20 through the connection cable 13. In this way, the input module 11 may be configured to receive an unlocking signal, and enable the electronic lock switch control module in the control box 20 to control release of an electronic lock (not shown) according to the unlocking signal.

In some embodiments, the input module 11 may include one or more input modes. In an embodiment, the input module 11 may include only a single input mode, for example, a short-range wireless module 111, a key module 112, or a biometric recognition sensing module (such as facial recognition, fingerprint recognition or voiceprint recognition). In another embodiment, the input module 11 may include a plurality of input modes. When the input module 11 includes a plurality of input modes, all control signals of the input module 11 may be integrated in one control circuit, and the control circuit is electrically connected to the electronic lock switch control module in the control box 20 through the connection cable 13. In some implementations, the short-range wireless module 111 may be a Bluetooth module, an infrared module, a near field communication module, a radio frequency identification (RFID) module, or another wireless transmission module satisfying short-range communications technologies. The short-range wireless module 111 may be preferably a Bluetooth module, and more preferably, a Bluetooth module satisfying a transmission specification above Bluetooth 4.0.

In this embodiment, as an example, the input module 11 includes two input modes, including the short-range wireless module 111 and the key module 112. For example, the short-range wireless module 111 may be a wireless receiver to receive a radio signal sent by an external wireless transmitter.

Next, referring to FIG. 1 to FIG. 5 together, the control box 20 includes a box body 21, a circuit board 22, a connection hole 23, a first port 24*a*, a cover body, a back plate 26, and a sensing assembly 27. The box body 21 may be a rectangular box body, and includes a front plate 211, a side plate and a back opening 213. The side plate may be any one of four sides surrounding the front plate 211, for example, an upper side plate 212 on an upper side of the box body 21 shown in FIG. 4, a lower side plate 214 parallel to and opposite to the upper side plate 212, or a left or right side plate adjacently connected between the upper side plate 212 and the lower side plate 214. In this embodiment, the upper side plate 212 on the upper side of the box body 21 shown in FIG. 4 is used as an example for description.

The circuit board 22 is disposed in the box body 21, and includes an electronic lock switch control module 221. The connection hole 23 is disposed on the circuit board 22, electrically connected to the electronic lock switch control module 221 through a cable on the circuit board 22, and embedded on the front plate 211. The connection cable 13 penetrates through the door plate 90 and is connected to the connection hole 23, to be electrically connected to the circuit board 22 inside the box body 21. In this way, the foregoing short-range wireless module 111 and the key module 112 may be electrically connected to the electronic lock switch control module 221 through the connection cable 13. In some embodiments, the connection cable 13 is a single-core cable, and simply transmits the unlocking signal to the electronic lock switch control module 221 of the circuit board 22 at the backend, to control a switch of the electronic lock. In addition, in this way, a case in which when the input panel 10 is dismounted, the signal is modified or transmitted through the connection cable 13 or the connection hole 23 between the input panel 10 and the control box 20 and the electronic lock is opened may be avoided.

The first port 24*a* is disposed on and electrically connected to the circuit board 22, and is embedded on the upper side plate 212. In some embodiments, the first port 24*a* may be a port of a power cable, a network cable, or an electronic lock control cable. In some embodiments, one or more first ports may be designed as required. In an example, the control box 20 may be provided with a single first port 24*a*. For example, the first port 24*a* may be a port of a power cable, and the power cable may be electrically connected to the circuit board 22 through the first port 24*a*, to provide power needed by electronic assemblies in the control box 20 and the input panel 10. Alternatively, the first port 24*a* may be a port of an electronic lock control cable. One end of the electronic lock control cable is electrically connected to the electronic lock switch control module 221 on the circuit board 22 through the first port 24*a*, and another end is electrically connected to the electronic lock, so that the unlocking signal sent by the electronic lock switch control module 221 may be transmitted to the electronic lock through this cable, to open the electronic lock. In another example, the control box 20 may be provided with a plurality of first ports 24*a* and 24*b*. For example, the first port 24*a* may be a port of the power cable, and another first port 24*b* may be disposed near the first port 24*a*. The first port 24*b* may be a network port configured to connect to a network cable. The network port (the first port 24*b*) is similarly disposed on the circuit board 22, electrically connected to the electronic lock switch control module 221 through the cable on the circuit board 22, and embedded on the upper side plate 212. In addition, the network port (the first port 24*b*) is connected to a wired or wireless router (Access Point) through an external network cable, so that the electronic lock switch control module 221 may transmit signals and information of modules of the circuit board 22 through the network. In addition, the first port 24*a* and the first port 24*b* may respectively be the port of the power cable and the port of the electronic lock control cable, or the network port configured to connect to the network cable and the port of the electronic lock control cable.

The cover body is disposed on the box body 21, and covers the upper side plate 212 on which the first port 24*a* is disposed. An upper cover body 25*a* disposed on and covering the upper side plate 212 is used as an example for description herein. As shown in FIG. 4, the cover body 25*a* may be a rectangular cover configured to completely cover the upper side plate 212 on which the first port 24*a* is disposed. In addition, an opening opened as required or an opening that is normally opened fixedly may be disposed in the upper cover body 25*a*. In this embodiment, the opening opened as required (which is referred to as a removable hole below) is used as an example. In some embodiments, one or more openings may be disposed in each upper cover body 25*a*, and the opening may be located on at least one of a left side, a right side, an upper side, and a back side of the upper cover body 25*a*. In this embodiment, removable holes 251 disposed on the left side and the right side of the upper cover body 25*a* are used as an example for description.

As shown in the drawing, the upper cover body 25*a* may form, by using a structure, the removable holes 251 that form openings through damages. A non-perforated removable hole 251 is disposed on each of the left side and the right side of the upper cover body 25*a*. Before the control box 20 is mounted on the door plate 90, depending on whether a power cable and a network cable penetrate through the upper cover body 25*a* from the left side or the right side of the upper cover body 25*a*, the removable hole 251 on the corresponding side of the upper cover body 25*a* is damaged to form a punched hole. Next, the power cable and the network cable penetrate into the upper cover body 25*a* through the perforated removable hole 251 and are respectively connected to the first port 24*a* and the network port 24*b*. In this way, the upper cover body 25*a* completely covers the first port 24*a* and the network port (the first port 24*b*), and the power cable and the network cable that are connected to the ports. After the control box 20 is mounted on the door plate 90, the perforated removable hole 251 is covered by making the perforated removable hole 251 of the upper cover body 25*a* approach side borders of the door plate 90.

In this way, because a joint between the port and the connection cable is covered and is not exposed at all, when the upper cover body 25*a* or the back plate 26 of the control box 20 is not dismounted, the power cable and the network cable cannot be damaged or removed easily from outside. Because the connection cable and the port are not exposed at all, the electronic lock switch is prevented from being controlled through a port, and from being intruded or tampered with by connecting to a cloud server through a port network.

In some embodiments, the upper cover body 25*a* may be integrated with the box body 21, or may be tightly combined with the box body 21 through a clip, or may be locked through a locking assembly such as a screw in a direction from the inside of the box body 21 to the upper cover body 25*a*, to avoid a case in which the upper cover body 25*a* is easily dismounted and the power cable or the network cable is removed or damaged. In other words, after the electronic lock apparatus is mounted on the door plate 90, a combination component (such as a clip assembly or a locking assembly) of the upper cover body 25*a* and the box body 21 is hidden inside the box body 21, or is covered by the back plate 26 or the door plate 90 and not exposed.

In this embodiment, as shown in FIG. 3 and FIG. 4, an L-shaped buckling part 253 is disposed on the bottom of each of the left and right sides of the upper cover body 25*a*. A sliding slot 2121 with a corresponding shape is disposed in a concave way on the upper side plate 212 of the box body 21. When the upper cover body 25*a* needs to be mounted in the box body 21, a back side of the box body 21 enables the buckling part 253 to slide into the sliding slot 2121. In this way, after the upper cover body 25*a* is mounted and the back plate 26 is locked to the upper cover body 25*a*, because of blocking of the back plate 26, the upper cover body 25*a* cannot be detached from the box body 21. That is, in the structure of this embodiment, when the upper cover body 25*a* is not damaged, the upper cover body 25*a* cannot be removed unless the back plate 26 is opened.

The back plate 26 is locked to the upper cover body 25*a*, and covers the entire back opening 213. The sensing assembly 27 is disposed on the circuit board 22, faces the back opening 213, and is configured to sense whether the back plate 26 performs any movement. For example, when a screw locking the back plate 26 is loosened at any corner, a corner of the back plate 26 arches, to cause a slight movement. Alternatively, when any impact or damage is caused to the back plate 26, a slight movement, for example, sinking or vibration of the back plate 26, may be caused. As long as there is any movement, the sensing assembly 27 may sense the movement and react in real time. In this embodiment, a relay switch is used as an example of the sensing assembly 27. When the relay switch is pressed, it indicates normality; and when the relay switch bounces, it indicates abnormity. That is, after the back plate 26 covers the back opening 213, and is locked, the relay switch is pressed, indicating a normal usage state. When the back plate 26 performs any movement and the original extent of pressing the relay switch is not maintained, the relay switch presents an abnormal state corresponding to any movement of the back plate 26. When the relay switch is abnormal, the electronic lock switch control module 221 may be triggered to generate an abnormal signal, and transmit the abnormal signal to a cloud server (a monitoring center) through the network, to give a warning.

In addition, as shown in FIG. 3, there is a convex inner frame 262 on a side, facing the back opening 213, of the back plate 26, to prevent an internal thief from using a foreign object to cover the sensing assembly 27 when attempting to open the back plate 26 to prevent transmission of the abnormal alarm signal.

In some embodiments, alternatively, the sensing assembly 27 may be an infrared sensor, and a convex part is disposed in a convex way on a side, facing the interior of the box body 21, of the back plate 26, and there is a hole in the convex part. When the back plate 26 is mounted in the box body 21, the hole in the convex part may let an infrared ray pass, to serve as the normal state. When the back plate 26 performs any movement, the convex part around the hole will block the infrared ray immediately, to serve as the abnormal state to give a warning.

When the electronic lock apparatus is mounted, a plurality of locking assemblies 30 may be used, which penetrate through the front plate 211 of the box body 21 and the hole 94 on the door plate 90 from the interior of the box body 21 of the control box 20, and are locked to the input panel 10. In this way, the input panel 10 and the control box 20 are simultaneously locked to the door plate 90. As shown in FIG. 3 and FIG. 4, in this embodiment, two locking assemblies 30 are used and disposed in a diagonal manner, penetrates through the front plate 211 of the box body 21 and the hole 94 on the door plate 90 from the interior of the box body 21 of the control box 20, and then are locked to a locking hole 14 of the input panel 10. After the locking assemblies 30 are locked, the back plate 26 is further covered. In this way, the locking assemblies 30 are located inside the box body 21. When the back plate 26 is not dismounted, the input panel 10 or the control box 20 cannot be dismounted without damages.

That is, the electronic lock apparatus of this embodiment needs to be dismounted according to a certain procedure. First, the back plate 26 of the control box 20 needs to be dismounted, then the input panel 10 may be dismounted from the interior of the control box 20, and the upper cover body 25*a* is dismounted. However, if the back plate 26 is dismounted in an unknown situation, the sensing assembly 27 is triggered first to give a warning. In addition, without dismounting the back plate 26, the input panel 10 cannot be dismounted without damaging the input panel 10. In addition, if the back plate 26 is not dismounted, the upper cover body 25*a* cannot be opened or removed, to avoid a case in which the port is exposed to cause the electronic lock and the network to be intruded or tampered with. In addition, in the structure of this embodiment, even though the input panel 10 is dismounted violently, none of the circuit board 22 of the control box 20, an electronic lock unlocking circuit, and a network interface port is exposed.

Based on the foregoing, after the electronic lock apparatus of this embodiment is mounted on the door plate 90, except the locking assemblies or a clip part for fixing the back plate 26 in the box body 21, all circuits, control circuits, circuit boards, locking assemblies, ports, and the like are hidden in the box body 21 or the upper cover body 25*a* and not exposed. In this way, when the back plate 26 is not dismounted, it is not easy to damage or disassemble electronic assemblies such as an internal control circuit or a cable. In addition, by disposing the sensing assembly 27, whether there is an abnormal state that the back plate 26 is dismounted may be detected, to give a warning, which further improves the function of anti-theft, network intrusion prevention, and internal theft prevention.

Referring to FIG. 1 to FIG. 5 together, in some embodiments, the control box 20 may further include a camera module 29. The camera module 29 is disposed on the circuit board 22, and is electrically connected to the electronic lock switch control module 221. A camera lens 291 of the camera module 29 protrudes out of the front plate 211 of the box body 21. In addition, after the control box 20 is mounted on the door plate 90, the camera lens 291 penetrates through the door plate 90, and the camera lens 291 is exposed from the input panel 10. The input panel 10 includes a punched hole 12 matching the camera lens 291, and the camera lens 291 penetrates through the input panel 10 through the punched hole 12.

By adding the camera module 29, controlling the electronic lock switch is not only limited to the short-range wireless module 111 and the key module 112 of the input module 11. The electronic lock switch may be managed individually through radio signal detection, physiological feature detection, image recognition or keyboard input, or through one or more combinations simultaneously, to enhance management and improve the anti-theft function. For example, information of the camera module 29 and information of the short-range wireless module 111 may be used simultaneously to determine whether to send the unlocking signal to open the electronic lock. For example, the camera module 29 may be used to capture an area image of a monitored area and perform image analysis on the area image to generate image information of at least one target object. Simultaneously, the short-range wireless module 111 receives at least one radio signal from at least one wireless transmitter. In addition, the image information of the at least one target object and the at least one radio signal are transmitted to the electronic lock switch control module 221. The electronic lock switch control module 221 may include a processing module and a memory, and store related comparison information. In this way, the electronic lock switch control module 221 may determine, according to at least one identifier of the at least one radio signal and the image information of the target object, whether to send the unlocking signal to open the electronic lock. The processing module may be implemented by one or more processing units herein, and each processing unit may be a microprocessor, a microcontroller, a digital signal processor, a microcalculator, a central processing unit, a field programmable gate array, a programmable logic device, a state machine, a logic circuit, an analog circuit, a digital circuit and/or any device operating a signal (analog and/or digital) based on an operation instruction.

In some embodiments, the control box 20 may further include a microphone 201 and a loudspeaker 202 that are disposed in the box body 21 and electrically connected to the circuit board 22. As shown in FIG. 3, the microphone 201 may be disposed at an upper left corner of the front plate 211 of the box body 21, and holes through which a voice may penetrate are further correspondingly disposed on the input panel 10 and the door plate 90, and the holes correspond to the microphone 201, so that a voice of a user outside the door plate 90 may penetrate through the door plate 90, and may be transmitted to the microphone 201 located in the box body 21 inside the door plate 90. In this way, voiceprint recognition may be further used or added to control the electronic lock switch. For example, a voice signal of a person intending to open the electronic lock may be obtained by using the microphone 201, and the microphone 201 outputs the voice signal to the electronic lock switch control module 221 for recognition and comparison, to determine whether to send the unlocking signal to open the electronic lock. In this way, identity recognition and verification may be performed on the person intending to open the electronic lock through a physiological recognition program (voiceprint recognition).

Further, when a final comparison result in the foregoing unlocking manners is unqualified, or when there is the abnormal state that the back plate 26 is dismounted, the electronic lock switch control module 221 may control the loudspeaker 202 to make a warning sound to give an alarm. In addition, when the person intending to open the electronic lock cannot open the door correctly and calls for help, the microphone 201 and the loudspeaker 202 may be further used by the person to talk to a background person on duty.

In some embodiments, the control box 20 may further include a second port 28 and another cover body covering the second port 28, and the box body 21 further includes another side plate. The another side plate may be any one, except the upper side plate 212, of side plates surrounding four sides of the front plate 211. In this embodiment, a lower side plate 214 on the lower side of the box body 21 shown in FIG. 4 is used as an example for description. The second port 28 is disposed on the circuit board 22 and embedded on the lower side plate 214. As an example for description, the another cover body is a lower cover body 25*b* disposed under the box body 21 and covering the lower side plate 214 on which the second port 28 is disposed. To protect the second port 28 disposed on the lower side plate 214 and a cable connected to the second port 28, the lower side plate 214 is similarly covered by using the lower cover body 25*b*, to be prevented from being damaged, removed or disassembled.

Similar to the foregoing upper cover body 25*a*, as shown in FIG. 4, the lower cover body 25*b* may be a rectangular cover configured to completely cover the lower side plate 214 on which the second port 28 is disposed. On left and right side plates of the lower cover body 25*b*, removable holes that form openings through damages may be formed by using a structure. One or more non-perforated removable holes may be disposed in each lower cover body 25*b*. As shown in the drawing, a non-perforated removable hole 251 is disposed on each of the left side and the right side of the lower cover body 25*b*. Before the control box 20 is mounted on the door plate 90, depending on whether a cable penetrates through the lower cover body 25*b* from the left side or the right side, the removable hole 251 on the corresponding side of the lower cover body 25*b* is damaged to form a punched hole. Next, the cable may penetrate into the lower cover body 25*b* through the perforated removable hole 251 in the lower cover body 25*b* and be connected to the second port 28.

In this embodiment, as shown in FIG. 3 and FIG. 4, an L-shaped buckling part 253 is disposed on the top of each of the left and right sides of the lower cover body 25*b*. A sliding slot 2141 with a corresponding shape is disposed in a concave way on the lower side plate 214 of the box body 21. When the lower cover body 25*b* needs to be mounted in the box body 21, a back side of the box body 21 enables the buckling part 253 to slide into the sliding slot 2141. In this way, after the lower cover body 25*b* is mounted and the back plate 26 is locked to the lower cover body 25*b*, because of blocking of the back plate 26, the lower cover body 25*b* cannot be detached from the box body 21. That is, in the structure of this embodiment, when the lower cover body 25*b* is not damaged, the lower cover body 25*b* cannot be removed unless the back plate 26 is opened.

In addition, when the lower cover body 25*b* is disposed, because the loudspeaker 202 is disposed on the lower side plate 214 of the box body 21, a plurality of small holes (not shown) may be further disposed on a bottom surface of the lower cover body 25*b*, so that a sound made by the loudspeaker 202 may penetrate through the lower cover body 25*b* and be sent out. In this way, the lower cover body 25*b* may be further used as a loudspeaker box simultaneously, so that the sound of the loudspeaker 202 is amplified and transmitted. The back plate 26 may be further changed to cover the entire lower cover body 25*b*. As shown in FIG. 2, the back plate 26 may cover and be locked to the upper cover body 25*a* and the lower cover body 25*b* located on the upper and lower sides, and completely cover the back opening 213 of the box body 21 of the entire control box 20.

When the upper side and the lower side of the control box 20 are respectively provided with the first port 24*a* (and 24*b*) and the second port 28, each of the first port 24*a* (and 24*b*) and the second port 28 may be the port of the power cable, the network cable, the electronic lock control cable, or the like as required in design. For example, the first port 24*a* is the port of the power cable, the first port 24*b* is the port of the network cable, and the second port 28 is the port of the electronic lock control cable. However, the present invention is not limited thereto.

In some embodiments, the inner surface 92 of the door plate 90 includes a door frame, and a side wall 93 of the door frame includes at least one opening 931. The door frame may be located in a location adjacent to a side edge in the inner surface 92 of the door plate 90, and the door frame and a body of the door plate 90 form a hollow passage. The cable connected to the electronic lock apparatus may penetrate into the hollow passage, to hide the cable, so that the cable cannot be easily damaged. In addition, the cable penetrating into the hollow passage may penetrate through the opening 931 of the side wall 93 and pass through the perforated removable holes 251 in the upper cover body 25*a* and/or the lower cover body 25*b*, to be connected to the ports (the first port 24*a*, the first port 24*b* and/or the second port 28) in the control box 20.

In some embodiments, when the electronic lock apparatus is mounted, the control box 20 is disposed on the inner surface 92 of the door plate 90 and closely adjacent to the side wall 93, and is located in the opening 931 corresponding to the side wall 93. Therefore, when the electronic lock apparatus is mounted, one or more locking assemblies 30 may be further used, penetrate through the side plate 216 (the left side plate or the right side plate) of the box body 21 from the interior of the box body 21 of the control box 20, and are locked to the side wall 93 of the door frame. Then, the back plate 26 is covered. In this way, the locking assemblies 30 are located inside the box body 21. When the back plate 26 is not dismounted, the input panel 10 or the control box 20 cannot be dismounted without damages.

Figure 6:
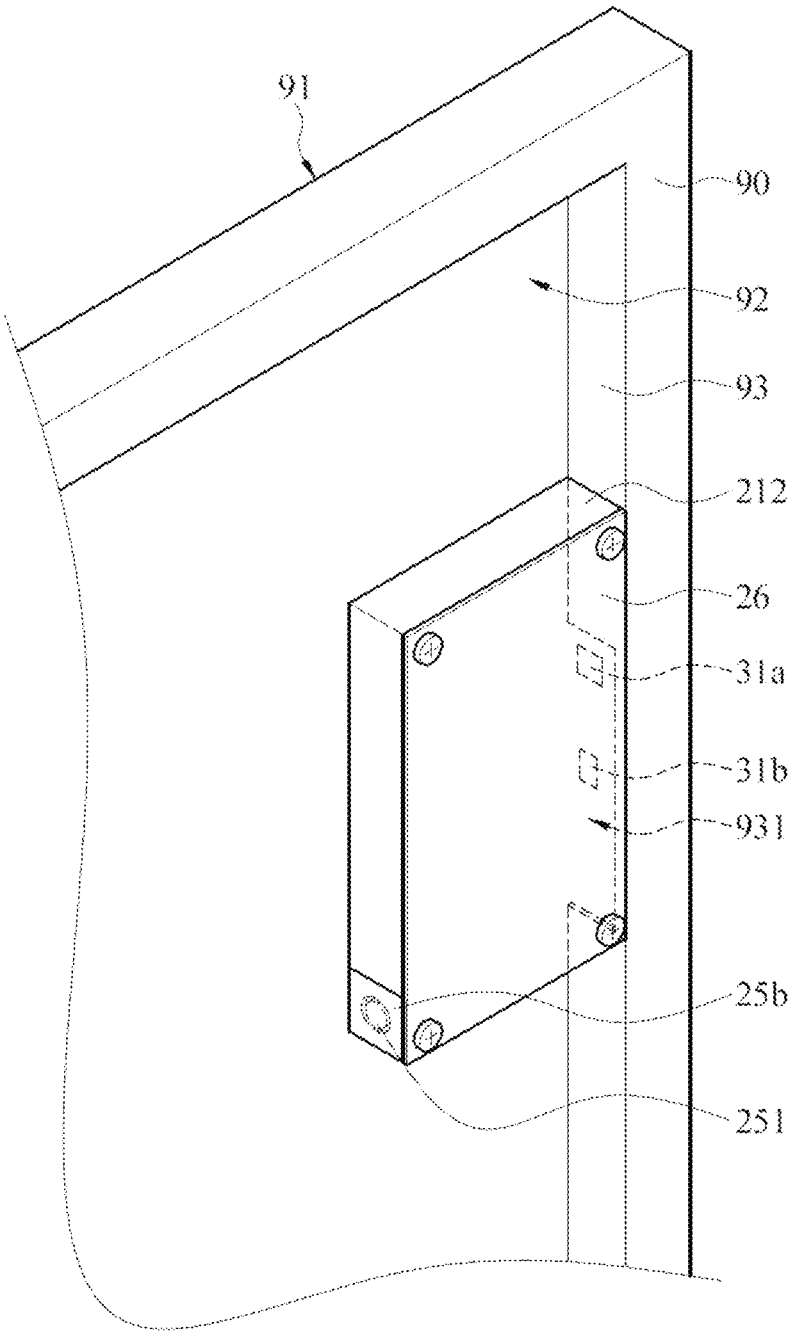
FIG. 6 is a rear view of an electronic lock apparatus according to a second embodiment of the present invention.
Figure 7:
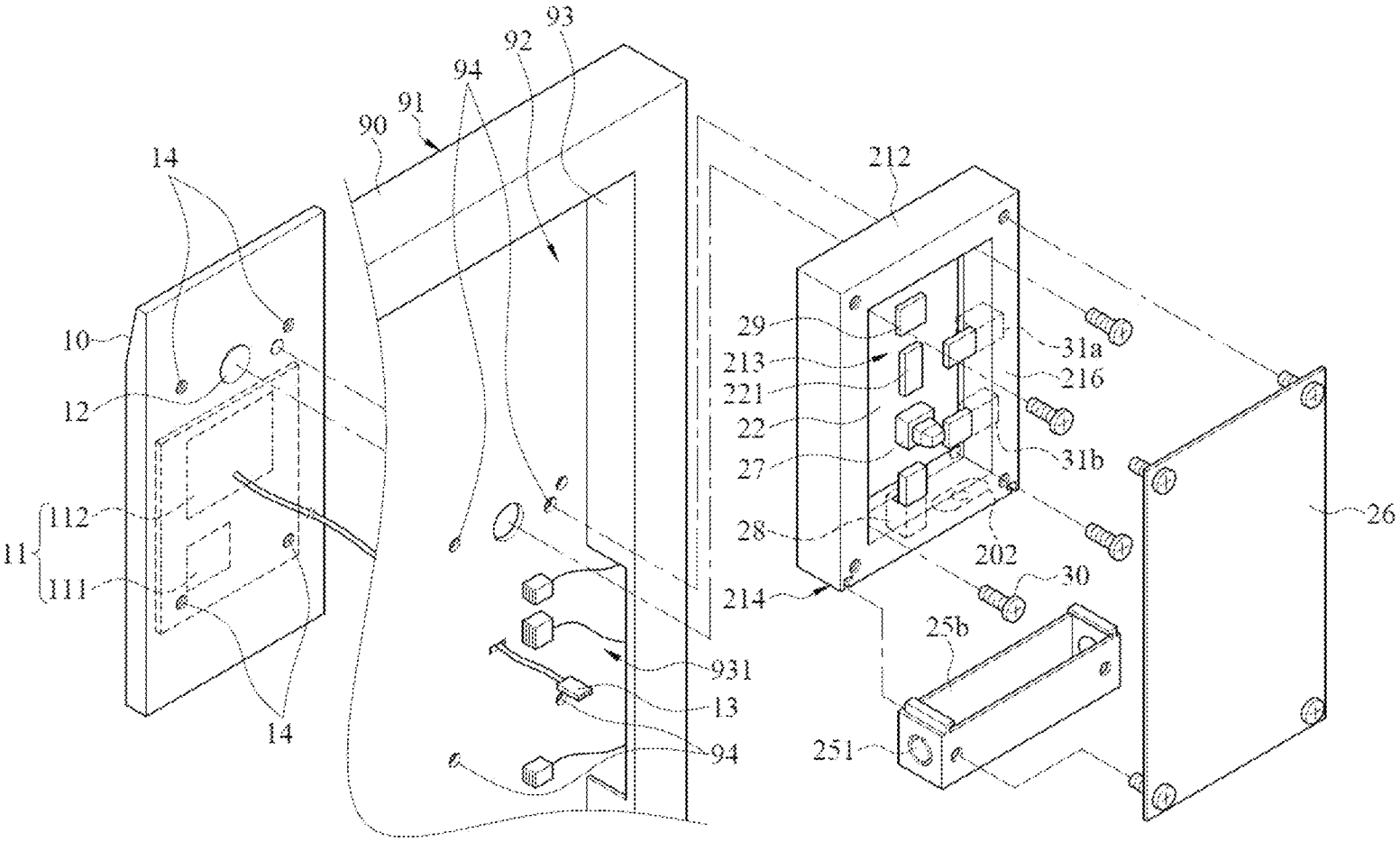
FIG. 7 is a schematic exploded view of the electronic lock apparatus according to the second embodiment of the present invention.

Next, referring to FIG. 6 and FIG. 7, and referring to FIG. 1 to FIG. 5 together when needed, FIG. 6 is a rear view of an electronic lock apparatus according to a second embodiment of the present invention; and FIG. 7 is a schematic exploded view of the electronic lock apparatus according to the second embodiment of the present invention. In some embodiments, a port 31*a* and a port 31*b* in the control box 20 may be further directly embedded on a side plate 216 (a left side plate or a right side plate) adjacently connected to the door plate 90. When this electronic lock apparatus is mounted, the cable penetrating into the hollow passage may penetrate through the opening 931 of the side wall 93, to be directly connected to the port 31*a* and the port 31*b* on the side plate 216. The port 31*a*/31*b* may be a port of a power cable, a network cable, or an electronic lock control cable.

Next, the plurality of locking assemblies 30 penetrate through the box body 21 and the door plate 90 through the back opening 213 of the box body 21, and are locked to the input panel 10, to fix the input panel 10 and the box body 21 on the door plate 90. Then the back plate 26 is locked to the box body 21, and covers the back opening 213. As shown in FIG. 6, in this embodiment, because the side plate 216, on which the ports are disposed, in the box body 21 is disposed closely adjacent to the side wall 93 of the door plate 90, after the box body 21 is mounted on the door plate 90, the side plate 216 is completely blocked by the side wall 93, so that none of the port 31*a* and the port 31*b* is exposed. In this way, because the port 31*a*, the port 31*b* and the connection hole 23 are covered and are not exposed at all, when the control box 20 is not dismounted, the control box 20 cannot be damaged or intruded easily from outside.

In addition, the control box 20 may further include the first port 24*a* (and/or 24*b*) and the upper cover body 25*a* covering the first port 24*a*. In addition, the control box 20 may further include the second port 28 and the lower cover body 25*b* covering the second port 28. In this case, when this electronic lock apparatus is mounted, after penetrating through the opening 931 of the side wall 93, in addition to being directly connected to the port 31*a* and the port 31*b* on the side plate 216, the cable penetrating into the hollow passage may further penetrate through the perforated removable holes 251 in the upper cover body 25*a* and/or the lower cover body 25*b*, to be connected to the ports (the first port 24*a*, the first port 24*b*, and the second port 28) in the upper side plate 212 and/or the lower side plate 214.

Figure 8:
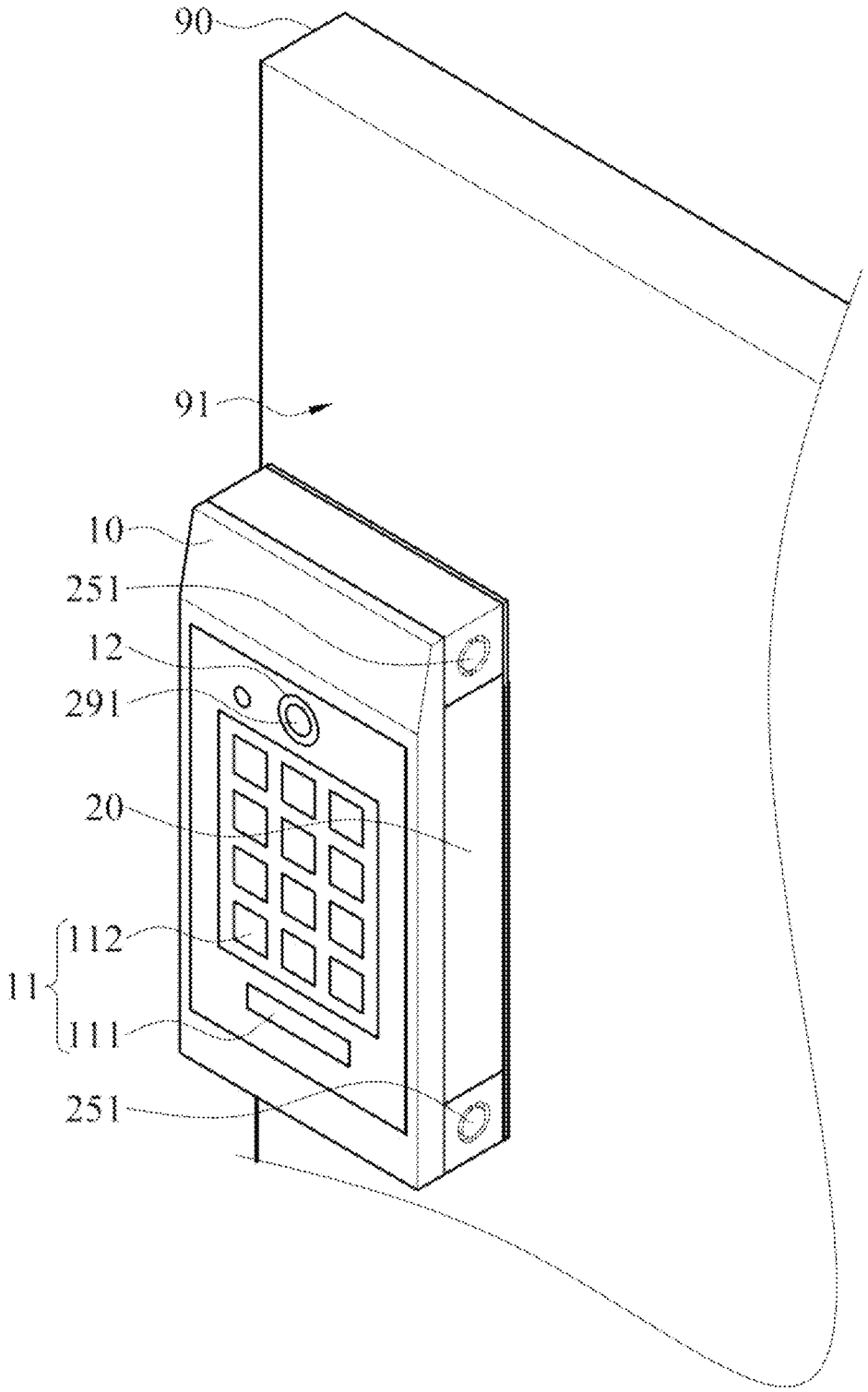
FIG. 8 is a rear view of an electronic lock apparatus according to a third embodiment of the present invention.
Figure 9:
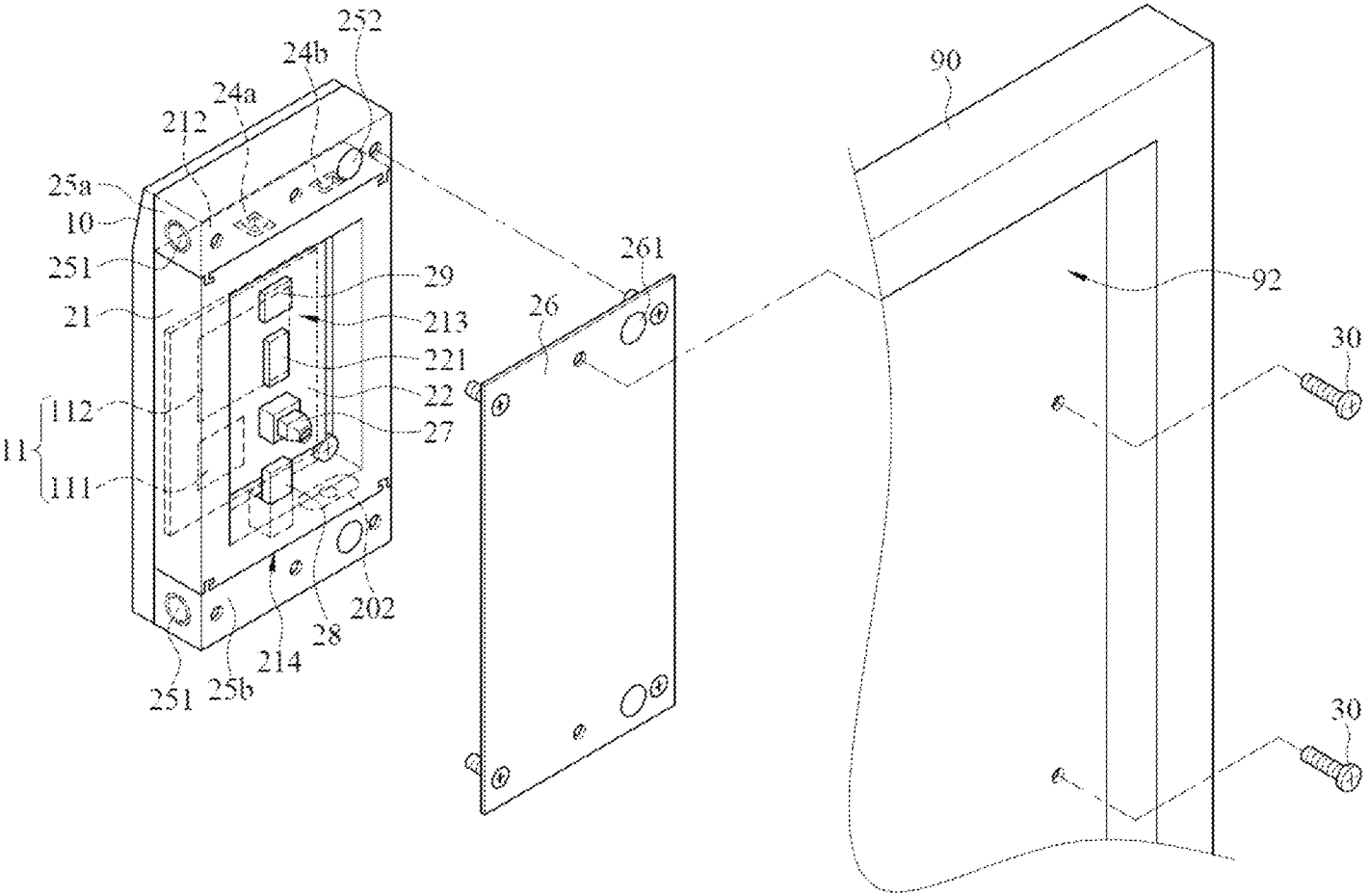
FIG. 9 is a schematic exploded view of the electronic lock apparatus according to the third embodiment of the present invention.

FIG. 8 is a rear view of an electronic lock apparatus according to a third embodiment of the present invention; and FIG. 9 is a schematic exploded view of the electronic lock apparatus according to the third embodiment of the present invention. Next, referring to FIG. 8 and FIG. 9, and referring to FIG. 1 to FIG. 5 together when needed. In some embodiments, the input panel 10 and the control box 20 may be combined into an integrated electronic lock apparatus, that is, the door plate 90 is not sandwiched between the input panel 10 and the control box 20 after assembly. In this case, the electronic lock apparatus may be mounted on an outer surface 91 of the door plate 90 or a wall near the door plate 90 through a manner of direct locking (as shown in FIG. 8 and FIG. 9) or a manner of holder fixing.

Similar to designs of the foregoing embodiments, in this embodiment, the control box 20 also includes a box body 21, a circuit board 22, a connection hole 23, a first port 24*a*, a cover body, a back plate 26, and a sensing assembly 27. In addition, the control box 20 may further include a second port 28 and another cover body.

In this embodiment, as an example for description, the cover body is disposed on and covers an upper cover body 25*a* of an upper side plate 212. As an example for description, the another cover body is disposed under and covers a lower cover body 25*b* of a lower side plate 214. As shown in FIG. 9, the upper cover body 25*a* and the lower cover body 25*b* are rectangular covers, and an opening opened as required or an opening that is normally opened fixedly may be disposed on a back side of each of the upper cover body 25*a* and the lower cover body 25*b*. In this embodiment, the opening that is normally opened fixedly (which is referred to as a removable hole 252 below) is used as an example. An external cable of the electronic lock apparatus may be connected, through the removable hole 252 from outside of the electronic lock apparatus, to the ports (the first port 24*a*, the first port 24*b* and/or the second port 28) covered by the upper cover body 25*a* or the lower cover body 25*b*.

In some embodiments, the opening opened as required or the opening that is normally opened fixedly may be disposed at a location, corresponding to the removable hole 252, of the back plate 26. The opening opened as required (which is referred to as a removable hole 261 below) is used as an example below. The removable hole 261 forms, by using the back plate 26, an opening formed through damages by using a structure. The back plate 26 is locked to the upper cover body 25*a* and the lower cover body 25*b*, and covers the entire back opening 213. In addition, after the back plate 26 is locked, the removable hole 252 and the removable hole 261 overlap, and the cable connected to the ports (the first port 24*a*, the first port 24*b* and/or the second port 28) covered by the upper cover body 25*a* and the lower cover body 25*b* may penetrate through the control box 20 through the removable hole 252 and the removable hole 261, and is further connected to an external assembly, to transmit a signal.

When the entire electronic lock apparatus needs to be mounted on the door plate 90, a plurality of locking assemblies 30 may be used to penetrate through the door plate 90 from the inner surface 92 of the door plate 90, and be locked to the back plate 26, even to the upper cover body 25*a* and the lower cover body 25*b*, to fix the electronic lock apparatus on the door plate 90. In this way, because the locking assemblies 30 are all located on the inner surface 92, the electronic lock apparatus cannot be dismounted from the outer surface 91. In addition, all connection cables and ports are hidden in the box body 21, the upper cover body 25*a* and the lower cover body 25*b* and not exposed, and therefore the electronic lock switch is prevented from being controlled through a port, and from being intruded or tampered with by connecting to a cloud server through a port network.

Moreover, when the entire electronic lock apparatus is not dismounted, the back plate 26 cannot be dismounted either to expose the circuit, the control circuit, the circuit board, the locking assemblies, the ports, and the like. In this way, when the electronic lock apparatus and the back plate 26 are not dismounted, it is not easy to damage or disassemble electronic assemblies such as an internal control circuit or a cable. In addition, even though the electronic lock apparatus is entirely dismounted, by disposing the sensing assembly 27, whether there is an abnormal state that the back plate 26 is dismounted may be detected, to give a warning, which further improves the function of anti-theft, network intrusion prevention, and internal theft prevention.

Figure 10:
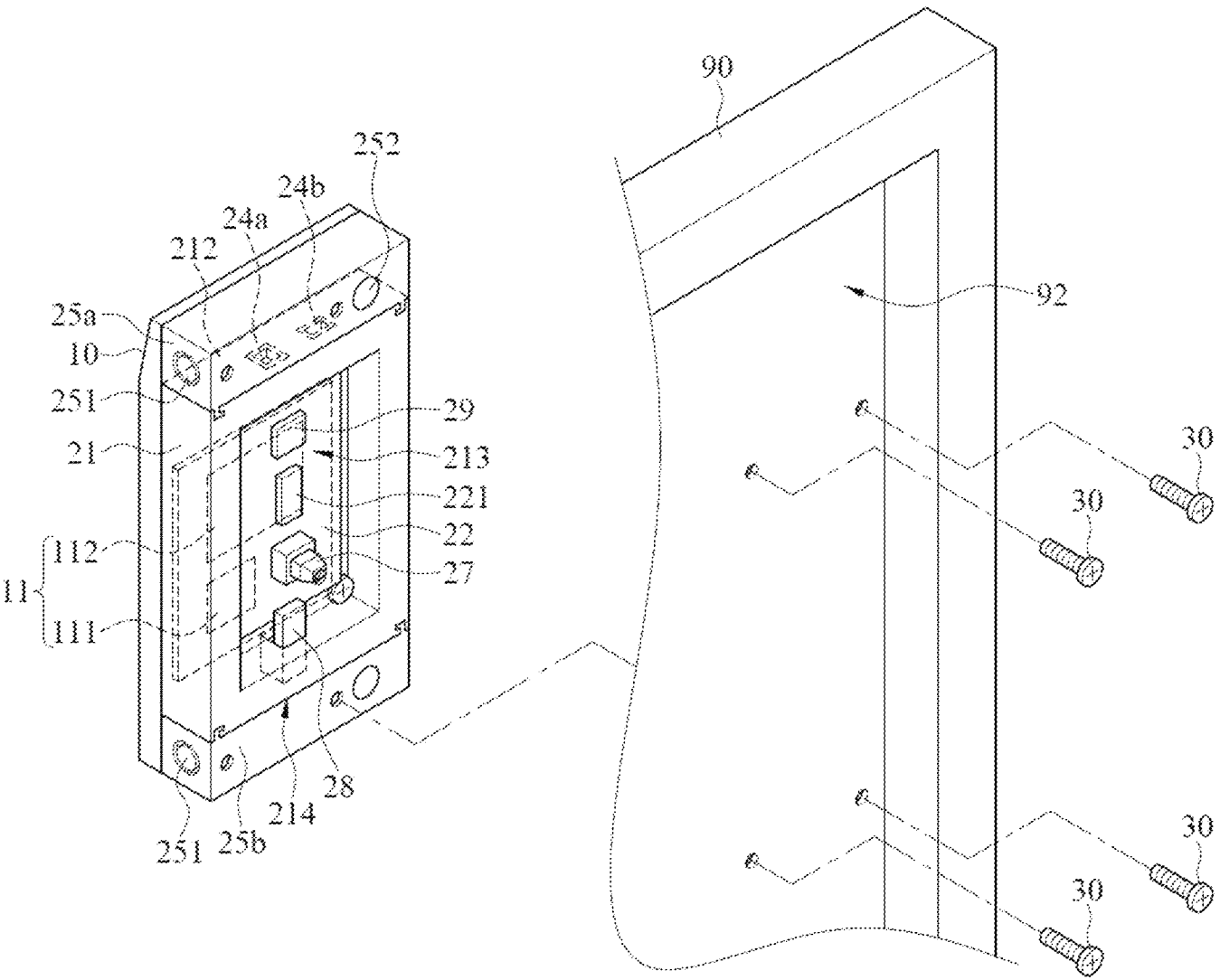
FIG. 10 is a schematic exploded view of an electronic lock apparatus according to a fourth embodiment of the present invention.

In some embodiments, when the input panel 10 and the control box 20 are combined into an integrated electronic lock apparatus to be mounted, the control box 20 may alternatively not include the back plate 26. The control box 20 may be directly locked to the door plate 90, to cover the entire back opening 213 by using the door plate 90. In this case, the sensing assembly 27 may be triggered by sensing whether the control box 20 and the door plate 90 perform any movement. For example, the plurality of locking assemblies 30 are used to penetrate through the door plate 90 from the inner surface 92 of the door plate 90, and locked to the upper cover body 25*a* and/or the lower cover body 25*b*, as shown in FIG. 10. In this way, the input panel 10 and the control box 20 are simultaneously locked to the door plate 90.

Based on the foregoing, after the electronic lock apparatus of this embodiment is mounted on the door plate 90, except a combination component (such as a locking assembly or a clip part) fixing the back plate 26 and the box body 21, all circuits, control circuits, circuit boards, locking assemblies, ports, and the like are hidden in the box body 21, or covered by the side wall 93 and not exposed, which prevents network intrusion or tampering performed through the ports. In addition, when the back plate 26 or the box body 21 is not dismounted, it is not easy to damage or disassemble electronic assemblies such as a control circuit or a cable. In addition, whether there is an abnormal state that the back plate 26 is dismounted may be detected through the sensing assembly 27, to give a warning, which further improves the function of anti-theft. In other words, the electronic lock apparatus according to the present invention can provide an unlocking manner of wireless, a biological feature, password entry or a combination thereof as a basis of controlling an electronic lock body, and may include a safety protection design such as anti-theft, internal theft prevention and network intrusion prevention, to improve safety of near-end and/or remote access control management.

Although the present invention has been described above with reference to the foregoing embodiments, the embodiments are not intended to limit the present invention. Any person skilled in the art may make variations and improvements without departing from the spirit and scope of the present invention. Therefore, the patent protection scope of the present invention should be subject to the appended claims in this specification.

What is claimed is:

1. An electronic lock apparatus, comprising:

an input panel, comprising an input module and a connection cable, wherein the connection cable is electrically connected to the input module; and a control box, comprising:

a box body, comprising a front plate, a side plate and a back opening;

a circuit board, disposed in the box body, and comprising an electronic lock switch control module;

a connection hole, disposed on the circuit board, electrically connected to the electronic lock switch control module, and embedded on the front plate, wherein the connection cable is correspondingly connected to the connection hole;

a first port, disposed on the circuit board and embedded on the side plate;

a cover body, disposed on the box body, and covering the side plate on which the first port is disposed;

a back plate, locked to the cover body and the box body, and covering the back opening; and a sensing assembly, disposed on the circuit board, facing the back opening, and configured to sense whether the back plate moves.

2. The electronic lock apparatus according to claim 1, wherein the control box further comprises a camera module, disposed on the circuit board and electrically connected to the electronic lock switch control module, a camera lens of the camera module protruding from the front plate of the box body.

3. The electronic lock apparatus according to claim 2, wherein the camera lens penetrates through a door plate, and the camera lens is exposed from the input panel.

4. The electronic lock apparatus according to claim 3, wherein the input panel comprises a punched hole matching the camera lens, and the camera lens penetrates through the input panel through the punched hole.

5. The electronic lock apparatus according to claim 1, wherein the control box further comprises a microphone and a loudspeaker that are disposed in the box body and electrically connected to the circuit board.

6. The electronic lock apparatus according to claim 1, wherein the input module comprises a short-range wireless module, electrically connected to the electronic lock switch control module through the connection cable.

7. The electronic lock apparatus according to claim 1, wherein the input module comprises a key module, electrically connected to the electronic lock switch control module through the connection cable.

8. The electronic lock apparatus according to claim 1, wherein the input module is configured to receive an unlocking signal, and the electronic lock switch control module controls release of an electronic lock according to the unlocking signal.

9. The electronic lock apparatus according to claim 1, wherein the control box further comprises a second port and another cover body, the box body further comprises another side plate, the second port is disposed on the circuit board and embedded on the another side plate, and the another cover body is disposed under the box body and covers the another side plate on which the second port is disposed.

10. An electronic lock apparatus, mounted on a door plate, wherein the door plate comprises an outer surface and an inner surface, a side wall with an opening is disposed on the inner surface, and the electronic lock apparatus comprises:

an input panel, disposed on the outer surface of the door plate, and comprising an input module;

a control box, disposed on the inner surface of the door plate and closely adjacent to the side wall, and corresponding to the opening of the side wall, wherein the control box comprises:

a box body, comprising a front plate, a side plate and a back opening, wherein the side plate is located on one side of the box body, the one side facing the side wall of the door plate;

a circuit board, disposed in the box body, and comprising an electronic lock switch control module;

a connection cable, disposed on the circuit board, electrically connected to the electronic lock switch control module, and penetrating through the front plate, to be connected to the input module;

a first port, disposed on the circuit board, embedded on the side plate, and corresponding to the opening;

a back plate, locked to the box body, and covering the back opening; and a sensing assembly, disposed on the circuit board, facing the back opening, and configured to sense whether the back plate moves; and a plurality of locking assemblies, penetrating through the box body and the door plate through the back opening of the box body, and locked to the input panel, to fix the input panel and the box body on the door plate.

11. The electronic lock apparatus according to claim 10, wherein the control box further comprises a camera module, disposed on the circuit board and electrically connected to the electronic lock switch control module, a camera lens of the camera module protruding from the front plate of the box body.

12. The electronic lock apparatus according to claim 11, wherein the camera lens penetrates through the door plate, and the camera lens is exposed from the input panel.

13. The electronic lock apparatus according to claim 12, wherein the input panel comprises a punched hole matching the camera lens, and the camera lens penetrates through the input panel through the punched hole.

14. The electronic lock apparatus according to claim 10, wherein the control box further comprises a microphone and a loudspeaker that are disposed in the box body and electrically connected to the circuit board.

15. The electronic lock apparatus according to claim 10, wherein the input module comprises a short-range wireless module, electrically connected to the electronic lock switch control module through the connection cable.

16. The electronic lock apparatus according to claim 10, wherein the input module comprises a key module, electrically connected to the electronic lock switch control module through the connection cable.

17. The electronic lock apparatus according to claim 10, wherein the input module is configured to receive an unlocking signal, and the electronic lock switch control module controls release of an electronic lock according to the unlocking signal.

18. The electronic lock apparatus according to claim 10, wherein the control box further comprises a second port and a cover body, the box body further comprises another side plate, the second port is disposed on the circuit board and embedded on the another side plate, and the cover body is disposed under the box body and covers the another side plate on which the second port is disposed.

19. The electronic lock apparatus according to claim 10, wherein the locking assemblies penetrate through the box body through the back opening of the box body, and are locked to the side wall, to tightly bind the side plate of the box body to the side wall of the door plate.

* * * * *